US009858903B2

(12) United States Patent
DeVuono

(10) Patent No.: US 9,858,903 B2
(45) Date of Patent: Jan. 2, 2018

(54) EFFICIENT ACOUSTIC ENHANCEMENT OF ENDPINS AND RECEPTACLES FOR STRINGED MUSICAL INSTRUMENTS AND THE LIKE USING CUSTOMIZED FILLER MATERIALS

(71) Applicant: Thomas J DeVuono, Louisville, KY (US)

(72) Inventor: Thomas J DeVuono, Louisville, KY (US)

( * ) Notice: Subject to any disclaimer, the term of this patent is extended or adjusted under 35 U.S.C. 154(b) by 0 days.

(21) Appl. No.: 15/056,943

(22) Filed: Feb. 29, 2016

(65) Prior Publication Data

US 2017/0249926 A1 Aug. 31, 2017

(51) Int. Cl.

| | |
|---|---|
| ***G10D 3/00*** | (2006.01) |
| ***G10D 1/02*** | (2006.01) |
| ***H04R 1/02*** | (2006.01) |
| ***H04R 1/08*** | (2006.01) |

(52) U.S. Cl.
CPC ..... *G10D 3/003* (2013.01); *H04R 1/026* (2013.01); *H04R 1/08* (2013.01)

(58) Field of Classification Search
CPC ..... G10D 3/003; H04R 1/026; H04R 1/08
USPC ..... 84/327, 280
See application file for complete search history.

(56) References Cited

U.S. PATENT DOCUMENTS 1,802,250 A * 4/1931 Gruppe ..... G10D 3/02 84/274
2,430,717 A * 11/1947 Hull ..... G10H 3/181 174/21 JC
2,974,556 A * 3/1961 Fawick ..... G10D 3/003 84/280
3,935,782 A * 2/1976 O'Brien ..... G10H 3/18 224/910
4,018,129 A * 4/1977 Hollander ..... G10D 3/003 84/280
4,037,505 A * 7/1977 Maples ..... G10D 3/003 84/280
4,179,973 A * 12/1979 White ..... G10D 13/06 446/419
4,681,009 A * 7/1987 Mouradian ..... G10D 3/06 29/460

(Continued)

FOREIGN PATENT DOCUMENTS

DE 19843789 A1 * 3/2000 ..... G10D 3/12
DE 19843789 A1 3/2000

OTHER PUBLICATIONS http://toneacoustics.com , Applicant's website.

*Primary Examiner* — David Warren
*Assistant Examiner* — Christina Schreiber
(74) *Attorney, Agent, or Firm* — Jerome E. Sacks

(57) ABSTRACT

The invention presented herein allows efficient modification of endpins for musical instruments such as cello or bass that use cavities in one or more components that accommodate filler material. The filler materials are composed of materials that affect the acoustic outcomes. The user can modify the endpin acoustic outcomes relatively quickly by changing the filler composition until a desired acoustic outcome is achieved. This allows various acoustic outcomes using the same shape, materials, and construction for the endpin components. Several embodiments are illustrated for endpins, pedestals, stringed instrument sound posts, interior blocks, bass bars, speaker legs and the like.

13 Claims, 8 Drawing Sheets

(56) References Cited

U.S. PATENT DOCUMENTS 5,212,331 A * 5/1993 Waldo ..... G10D 13/06 84/404
5,289,751 A * 3/1994 Light ..... G10G 7/00 239/51.5
5,483,859 A * 1/1996 Singer ..... A63H 5/00 446/419
5,681,023 A * 10/1997 Sheydayi ..... H04R 1/026 248/346.11
5,817,959 A * 10/1998 Kagan ..... G10D 3/003 84/280
5,852,250 A * 12/1998 Cha ..... G10G 5/00 84/327
5,889,222 A * 3/1999 Burgess ..... G10D 3/00 84/279
5,942,735 A * 8/1999 Liang ..... F16F 3/0876 181/207
6,127,611 A * 10/2000 VansEvers ..... G10D 3/003 84/294
6,365,810 B1 * 4/2002 Enhoffer ..... G10D 13/06 446/421
6,555,736 B1 * 4/2003 Delosreyes ..... G10D 13/06 84/402
6,696,626 B1 * 2/2004 Pagenkopf ..... G10D 3/003 84/280
6,998,523 B1 * 2/2006 DeVuono ..... G10D 3/003 84/280
7,342,160 B2 * 3/2008 Alberti ..... G10D 3/003 84/280
D658,162 S * 4/2012 DeVuono ..... D14/222
8,735,702 B1 * 5/2014 Miles ..... A61F 2/013 84/327
9,263,019 B2 * 2/2016 Dahl ..... G10H 3/143
2005/0235806 A1 * 10/2005 Alberti ..... G10D 3/003 84/327
2006/0156896 A1 * 7/2006 Perkins ..... G10D 3/003 84/327
2006/0278059 A1 * 12/2006 Gipson ..... G10H 1/32 84/302
2017/0249926 A1 * 8/2017 DeVuono ..... G10D 3/003

* cited by examiner

Third Embodiment

Fourth Embodiment

EFFICIENT ACOUSTIC ENHANCEMENT OF ENDPINS AND RECEPTACLES FOR STRINGED MUSICAL INSTRUMENTS AND THE LIKE USING CUSTOMIZED FILLER MATERIALS

STATEMENT REGARDING FEDERALLY SPONSORED RESEARCH OR DEVELOPMENT

Not Applicable.

REFERENCE TO SEQUENCE LISTING, TABLE, OR A COMPUTER PROGRAM LISTING

Not Applicable.

COMPACT DISK APPENDIX

Not Applicable

BACKGROUND OF THE DISCLOSURE

There are many patent documents and commercial products describing tail pieces, endpins, and end piece receptacles for stringed musical instruments such as a cello, bass or the like. The approach often taken specifies the specific shapes and materials defining the structure of the endpins and receptacles. Arguments are then made as to why these designs will give a desired performance related to timber, loudness, and tone. Examples of the patent documents are U.S. Pat. No. 6,127,611 by VanEvers, U.S. Pat. No. 4,018,129 by Hollander, 2006/0278059 by Gipson. DeVuono's prior art patent, U.S. Pat. No. 6,998,523, and D658,162S are included in these documents. However, there does not exist a general approach to quickly modify the design to customize the acoustic outcomes of these designs. Therefore, there is a need for a design approach that allows the user to quickly make modifications to the device to achieve a favorable acoustic outcome.

SUMMARY OF THE DISCLOSURE

The invention presented herein solves the problem of provided endpins, end piece receptacles, and the like for musical instruments such as a cello or bass that are constructed using cavities in one or more components that accommodate filler materials. The filler materials are composed of materials that intend to enhance the acoustic outcomes. Endpin's acoustic outcomes may be modified relatively quickly by changing the filler material composition until a preferred acoustic outcome is achieved. This allows various acoustic outcomes using the same shape, materials, and construction of the endpin components.

In a first embodiment, an endpin is constructed from an elongated hollow rod secured at its first and second ends with set screws. Contained in the rod is filler material that is selected to control the acoustic outcome of the instrument. Attached to rod first end is a curved stopper with stopper first internal threads located on stopper first end that screws into external threads located on the rod first end. Stopper second end is attached to a tip having a tip body and tip screw. The stopper second end has second internal threads that attach tip to stopper with male tip screw Other embodiments are included, including application of the inventive concept for receptacles and string instrument interiors.

DETAILED DESCRIPTION

Directional terms such as "front", "back", "in", "out", "downward", "upper", "lower", and the like may be used in the description. These terms are applicable to the embodiments shown and described in conjunction with the drawings. These terms are merely used for the purpose of description in connection with the drawings. The term musical instrument is understood in a general sense to include typical musical instruments such as a cello or bass, and other devices used to produce musical sounds such as speakers and pianos. The term acoustic device refers to endpins, tailpieces, legs, posts or other devices used with a musical instrument to enhance the acoustic outcome.

Figure 1:
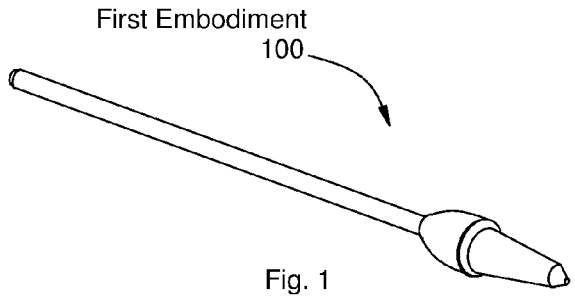
FIG. 1 illustrates a first embodiment of an endpin of the current invention.
Figure 1A:
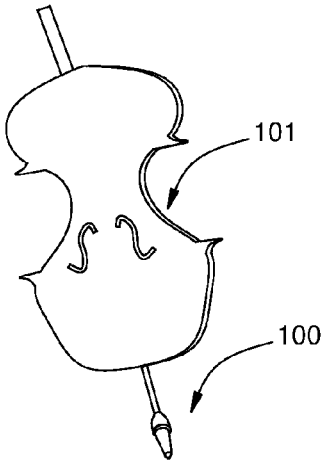
FIG. 1*a* illustrates the first embodiment being used with a musical instrument.
Figure 2:
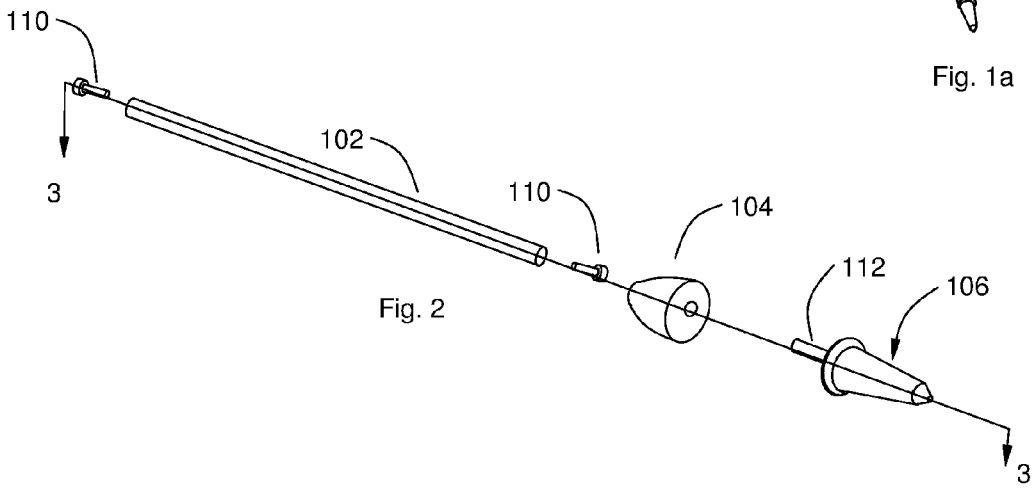
FIG. 2 presents an exploded view of FIG. 1.

FIG. 1 shows an endpin of the first embodiment 100 of the present invention. FIG. 1*a* illustrates the first embodiment 100 being used with a musical instrument 101. FIG. 2 illustrates first embodiment 100 in an exploded view. The endpin is constructed from a rod 102, a stopper 104 having two set screws 110, and a pointed tip 106 having a tip screw 112.

Figure 3:
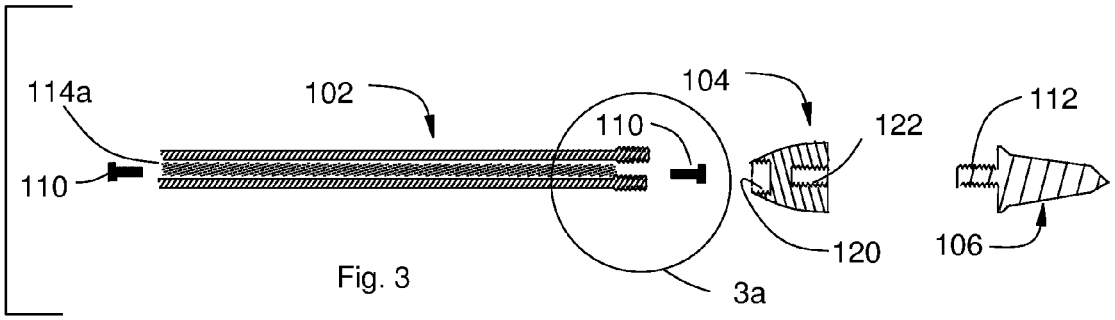
FIG. 3 illustrates a sectional view of the first embodiment.
Figure 3A:
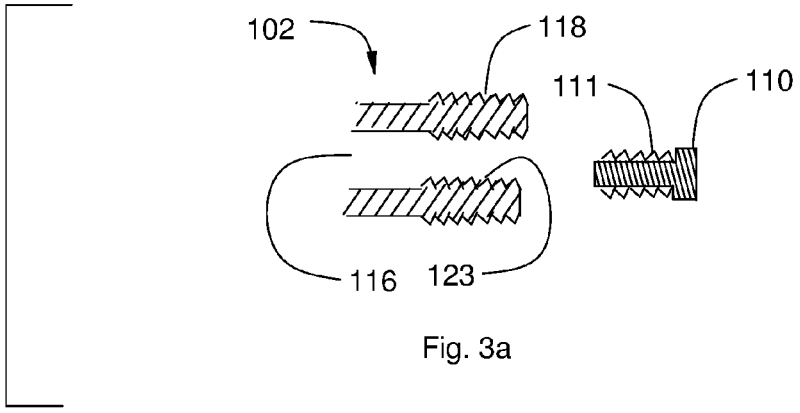
FIG. 3*a* illustrates a portion of FIG. 3 in an expanded scale.

FIG. 3 illustrates a cross sectional view of FIG. 2 with filler material 114*a*. FIG. 3*a* illustrates a portion of FIG. 3 in an expanded scale, shown without the filler material. Referring to FIGS. 3 and 3*a*, rod 102 has a shaft 116 drilled through the length of its interior and filled with a filler material 114*a*. Two set screws 110 have first male threads 111 that are matched to first female threads 123 located on the ends of shaft 116 that are used to removably seal the shaft 116 after filler material 114*a* is packed into the shaft. Rod 102 additionally has second male threads 118 that are matched to second female threads 120 located on left of stopper 104. In alternate embodiments, the set screws may be replaced by other mechanisms for removably sealing the shaft 116, such as rubber plugs, corks, and metal stoppers.

Figure 4:
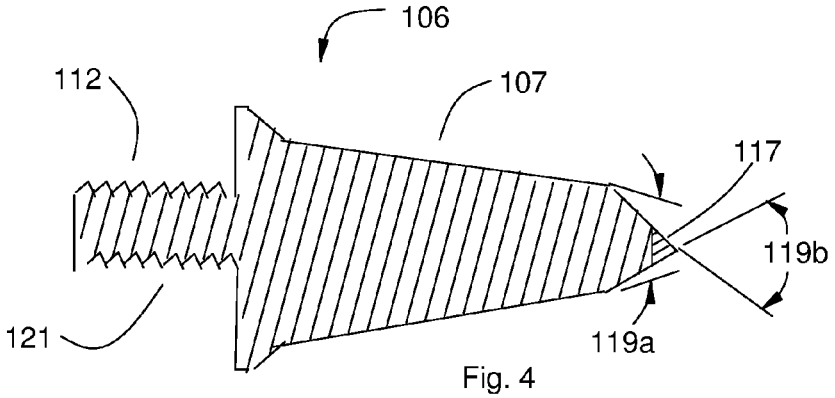
FIG. 4 illustrates the pointed tip of FIG. 3 in an expanded scale.

Stopper 104, shaped as shown in FIGS. 3, 3*a* and 4, has third female threads 122 located on right end of stopper that are matched to third male threads 121 located on left end on tip screw 112 emanating from pointed tip 106 as shown. Stopper 104 may be made of the same material as tip body 107 or from a different material and jointed to tip body.

FIG. 4 is a cross-section of pointed tip 106. It is composed of tip screw 112, tip body 107 and tip point 117. Tip point 117 has a tip body angle 119*a* and tip point angle 119*b*. For the first embodiment of a tip body angle 119*a* is 21 degrees and tip point angle 119*b* of 63 degrees. Alternate embodiments of the first embodiment may have different angles, depending on size material and instrument.

The left end of rod 102 fits into the instrument body. It can come in various lengths, and may additionally have an adapter to match the rod to the orifice on the instrument that it is attached to. The remaining components of first embodiment 100 are of greater mass. This makes the vibration move in that direction towards the tip and then to the ground.

The rod 102 of the first embodiment is made of brass. Rods of the first embodiment have various sizes, depending on the application. Typical sizes are an outside diameter of 7 mm (0.276 in), 8 mm (0.315 in), 10 mm (0.394 in), 12.7 mm (0.500 in) or custom cut larger for some acoustic bass instruments. Alternate embodiments have an outside diameter up to 16.5 mm (0.650 in). Rod length can range between 20 cm (8 in) and 61 cm (24 in) and is cut to suit the instrument and end user preferred play angle and position. The shaft 116 is drilled through rod 102 and has 4 mm (0.157 in) shaft on 8 mm (0.315 in) rods and/or a 6.35 mm (0.250 in) shaft on the larger haft on the larger diameter rods centered along the longitudinal axis. This shaft 116 in alternate embodiments may be larger or smaller depending on the choice of material and/or size.

The pointed tip 106 has tip body 107 of brass, and the top point tip is made of tungsten and brazed to the tip body 107. The dimensions of the rod are given above. Stopper/dome in this embodiment has a height of 0.375 in (9.54 mm) with a 0.875 in ((22.2 mm) diameter decreasing to a diameter of 0.625 in (15.8 mm) diameter. The tip is 1.5 in (38.07 mm) long with two primary angles. The dimensions of the stopper/dome in alternate embodiments may vary from these dimensions depending on size, materials and instrument.

The pointed tip 106 is unique in the ratios used and the way the brass is drilled and the tungsten is brazed. The pointed tip 106 is user replaceable if there is an upgrade or if it is damaged, or could be replaced with the ball tip 302 (see third embodiment 300 discussed below).

The first embodiment was originally used by the Inventor without the filler material 114*a* with excellent acoustic results for a particular cello. However, when applied to other string instruments, the results were less satisfactory. Favorable acoustic outcomes were therefore achieved by varying the filler material 114*a* by trial and error. The filler material 114*a* used include various pellets or powdered materials depending on the acoustic properties desired. Examples of filler material are given in Table 1, together with their acoustic properties.

TABLE 1

Filler Materials and their Properties

| | Filler Materials | Acoustic Properties |
|---|---|---|
| 1 | s70 steel shot | helps control resonance of the base material |
| 2 | s110 steel shot | same resonance control better greater frequency extension |
| 3 | s70 and s110 steel shot blend. | More frequency extension than s70 steel shot less than s110 |
| 4 | Bronze shot | overdamped sound and over control of natural resonance of instrument. |
| 5 | Bronze powder | extremely damped sound |
| 6 | s110 steel shot and neodymium powder blend | control and extension of sound |
| 7 | S110 steel shot, neodymium powder and magnetic pellets | Control and extension of frequency extremes with greater focus and detail of individual notes |
| 8 | Copper powder or pellets neodymium powder and magnetic pellets | Warmer tone with frequency extension and detail yet maintains focus and detail of individual notes. |

The Inventor has particular success with acoustic outcome by using magnetic pellets and powders added to the filler material. The magnetic pellets and powders have the acoustic characteristics of providing more coherent and focused sound that makes the instrument more reactive and responsive to input.

Figure 5:
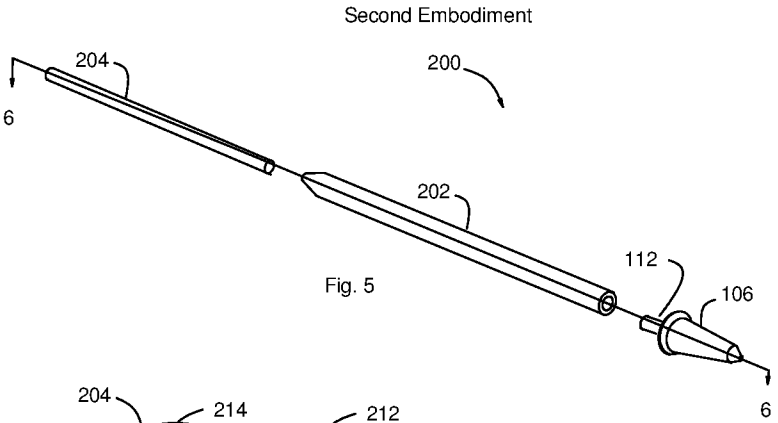
FIG. 5 illustrates an exploded view of a second embodiment of the current invention.
Figure 6:
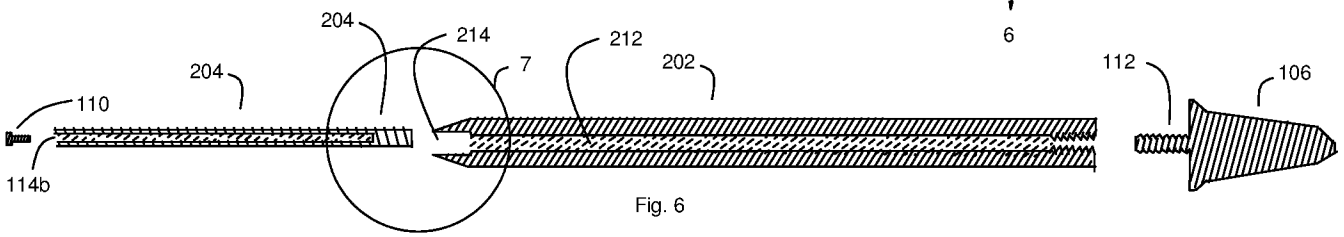
FIG. 6 is a sectional view of FIG. 5.
Figure 7:
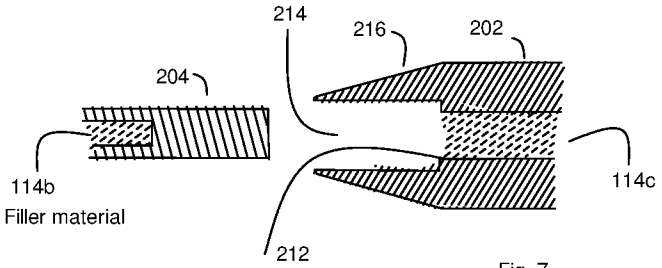
FIG. 7 illustrates a portion of FIG. 6 in an expanded scale.

FIGS. 5 through 7 illustrate a second embodiment 200 of the current invention. Only the differences between the first and second embodiments are discussed here in detail. The second embodiment 200 has a rod 202, a pointed tip 106 a stem 204, and has filler material 114*b*. Stem 204 fits into the left end of rod 202. Stem 204 has a second shaft 212 that is drilled on the left end of stem 204, containing filler material 114*c*. The right end of stem 204 is matched to a cavity 214 located on rod left end 216; cavity 214 has a slightly larger diameter than second shaft 212 located along the remaining longitudinal axis of rod 202. The rod left end 216 is tapered as shown. Stem 204 have typical diameters of 7 mm (0.28 in) for bass clarinet, 8 mm (0.315 in) or 10 mm (0.394 in) for cello or bass, and 12.7 mm (0.5 in) for special applications. Some specialty rods can be larger. Rod 202 typically has diameter between 15.875 mm (0.625 in) and 22.225 mm (0.875 in).

An s70/s110 steel pellet blend was used for filler materials 114*b* and 114*c*. Also used was a 110/neodymium magnetic in a first prototype for the second embodiment and had the same material as filler material 114*a*. However, modifications to the filler material were made iteratively by trial and error. Excellent results were obtained for s110 steel shot and neodymium magnetic powder blend with magnetic pellets added.

Figure 8:
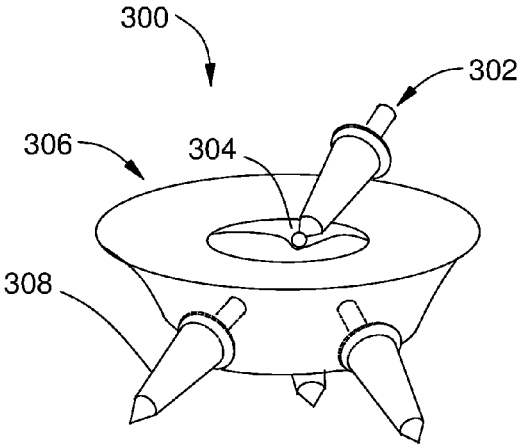
FIG. 8 a perspective view of an end piece receptacle comprising a third embodiment of the present invention.
Figure 9:
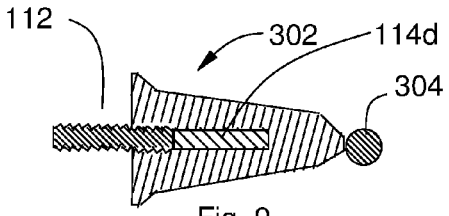
FIG. 9 illustrates a sectional view of the tip component of the third embodiment.
Figure 10:
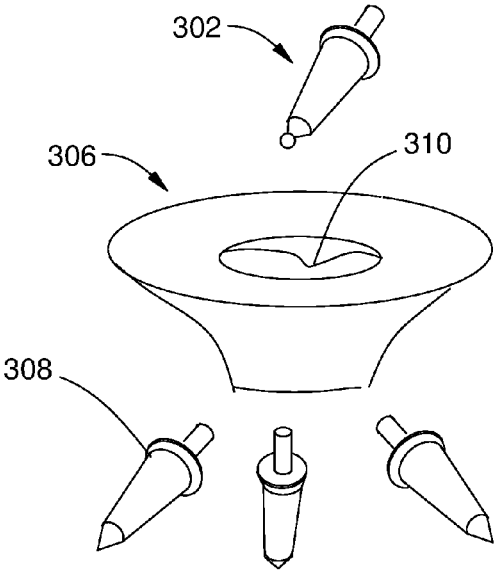
FIG. 10 is an exploded perspective view of FIG. 8.
Figure 11:
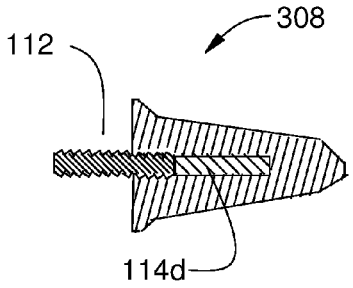
FIG. 11 illustrates a sectional view of a leg component of the third embodiment.

FIGS. 8 through 11 illustrate a third embodiment 300 of the present invention, which is a modification of the Inventor's D658,1625S design patent. Third embodiment 300 replaces the pointed tip 106 of embodiment 2 by a ball tip 302 and pedestal 306. The ball tip 302 has a sphere 304 attached to its end. Referring to FIGS. 8, 9 and 11, third embodiment 300 has pedestal 306 with a depression 310 that accommodate the sphere 304 that allows ball tip 302 to rotate freely within it. Additionally, third embodiment 300 has three legs 308 that attach to pedestal 306. In the third embodiment, the three legs 308 have the properties of pointed tip 106 of the first embodiment, although other types of legs, or the absence of legs, are also consistent with the inventive concept. Sphere 304 of ball tip 302 has radius 0.075 inches, and the pedestal, made of brass, three inch across legged bottom and 4 inches across the top.

FIG. 9 is a sectional view of ball tip 302, and FIG. 11 is a sectional view of leg 308. Both ball tip 302 and legs 308 use filler material 114*d*. The filler material 114*a* used in the first embodiment was used here also. In an alternate to the third embodiment, filler material used was s110 neodymium magnetic powder.

Figure 13A:
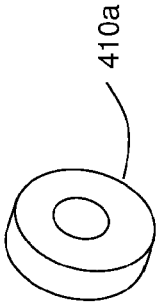
FIGS. 13*a* through 13*c* illustrate 3 versions of locking nuts of the fourth embodiment of the current invention.
Figure 13B:
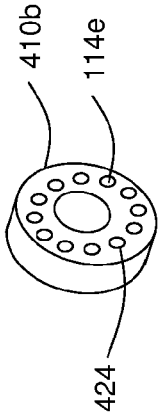
Figure 13C:
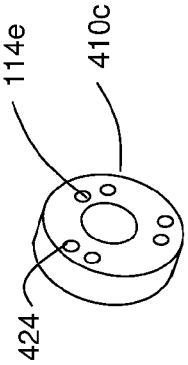
Figure 12:
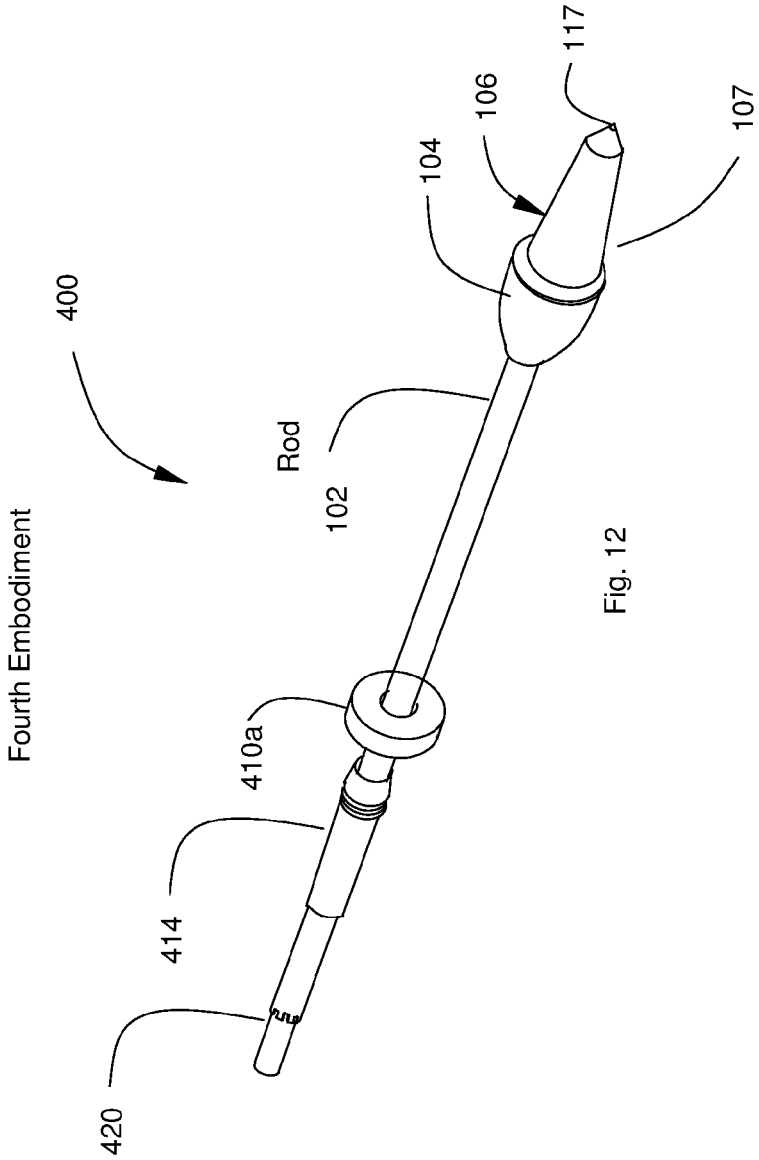
FIG. 12 illustrates a perspective view of a fourth embodiment comprising an endpin.

FIG. 12 illustrates a fourth embodiment 400. This embodiment has a locking collet nut 410*a* that attaches and secures a tapered collet body 414 with a castle 420 at left end of the rod 102. The feature, like that of a castle 420, reduces standing wave resonance. Instead of one large smooth area that would generate one large resonance peak, the castle 420 breaks what could be one large single resonance into several smaller and separated peaks or nodes that will not overlap nor add to each other by becoming a single resonance peak. Several smaller resonances are less audible than one large dominating resonance peak FIG. 13*a* illustrates locking collet nut 410*a*. Alternate embodiments to locking collet nut 410*a* illustrated in FIGS. 13*b* and 13*c* which has twelve bores (FIG. 13*b*) or six bores (FIG. 13*c*). The reaction of the fourth embodiment with the use of any of the three locking collet nuts 410*a* through 410*c* will be apparent and have a different resonance character depending on which collet nut is used. These resonance characteristics will also be different on different instruments and the choice which to use will be the preference of the musician or designer.

Referring to FIGS. 12 through 13*c*, rod 102 is inserted into tapered collet body 414 and secured and clamped with a locking collet nut 410. Second collet nut 410*b* has twelve bores 424 drilled to reduce mass when compared to locking collet nut 410*a* or hybrid collet nut 410*c* medium mass lock nut. Second collet nut 410*b* has filler material 114*e* added to four of the twelve bores. These four bores are then sealed to retain the fill material. (Details of the seals and filler are not shown in FIGS. 410*b* and 410*c*). The end user has a choice of what reactive material mass with the substitution of any of the locking collet nuts 410*a* through 410*c*. Variations of bores 424 may be made by the designer.

The fact that these areas of the castle 420 are cut around the circumference of the tapered collet means the spacing is not at a predictable repeatable pattern. These irregular cut facets and varied geometric shapes of the castle 420 will also help generate more diverse acoustic patterns and angles of pressure moving off the surface of the tapered collet and onto the radiating wood surface of the instrument. The castle 420 provides the additional performance advantage over the prior art.

The tapered collet body 414 is threaded into the instrument so it does not move as the wooden instrument changes with temperature and humidity. This was introduced by Klaus Bender. However, unlike the Bender and others, the tapered collet body 414 which for this example is used in a cello has a length of 63.5 mm (2.5 in) and extends well past the usual wooden support block of a cello. The support block is typically 1 to 1.5 inches in thickness/height and is internal to a cello. For viola or violin or any other string instrument that may use a button or endpin plug the scale and length inside the instrument can be recalculated to suit a particular instrument and yet extend well past the wooden support block of that chosen instrument. The purpose of this extra length is to increase the effective radiated acoustic collection area within the instrument body. Other designs rely solely on energy transmission thru the typical wooden block and do not collect airborne energy from within the instrument cavity. The benefit is that the instrument will radiate more energy through its external surface, an enhancement for both player and audience. The entire surface of the tapered collet has threads (threads not illustrated in the drawings). The threaded area above the wooden block is again an acoustic benefit. The threads actually increase the surface area of the taper and allow for the capture of more acoustic energy and sound pressure. This is preferable to a smooth extended surface which has less surface area than the same circumference and length. A smooth tapered body could be used, but threaded is preferred. These same threads, because they are at a tapered ratio and angle along the circumference of the tapered body capture frequencies that will not overlap and would serve to reinforce each other. This way is better because no single frequency will overlay another. Hence, no single frequency can dominate another.

Interchanging the locking collet nuts 410*a* through 410*c* causes a change in resonance and tone within the instrument, cello or bass. Another benefit of this feature is that it changes the string response of the instrument both in the free hand or with the bow. This reactive variability is at the choice of the player and their preference in playability and resonance response.

Figure 14:
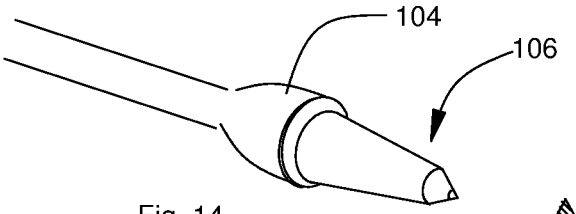
FIGS. 14 and 15 illustrate a perspective view and a sectional view respectively of the stopper and tip of the fourth embodiment of the current invention.
Figure 15:
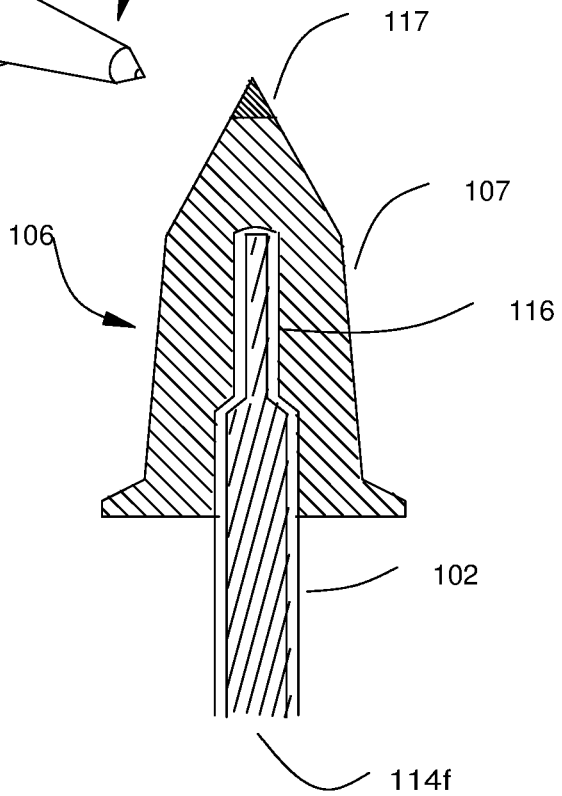

Referring to FIGS. 12, 14 and 15, rod 102 in this rendition is 0.500 inches in diameter. This rod is brass or an alloy but could be carbon fiber, or bronze or a bronze alloy, or aluminum or an aluminum alloy. Rod 102 in this fourth embodiment is hollow and then filled with filler material 114*f*. Each end of the rod 102 is sealed with one of the two set screws 110 to seal in this material. One end of 102 is threaded on its outside diameter to accept stopper 104. Stopper 104 is shaped and fitted to the rod 102 so vibrational energy and resonance is directed to the tip screw 112 attached to tip body 107 which contacts a higher mass surface, such as a stage floor. Tip body 107 has a tungsten cobalt insert that is sharp and strong to secure to most any wooden surface without the use of any other device to stop the instrument or device from slipping.

Referring to FIG. 15, filler material 114*f* is imbedded in shaft 116 positioned in rod 102 can be used to further modify the resonance and tone. While the metallic components in the fourth embodiment 400 are designed to give an initial resonance and tone that the designer wants to achieve, further enhancements to the sound may be made by adjusting the filler material 114*f* in the rod 102. In addition, the filler material 114*e* located in the bores 424 in the locking collet nuts 410 further allow minor adjustments to the resonance and tone.

The actual material used for the filler was determined by trial and error for the fourth embodiment. The filler material described in the previous embodiments may be used. The Inventor has had good success using ferrous bearing neodymium magnetic powder and magnetic spheres for this embodiment.

Figure 16:
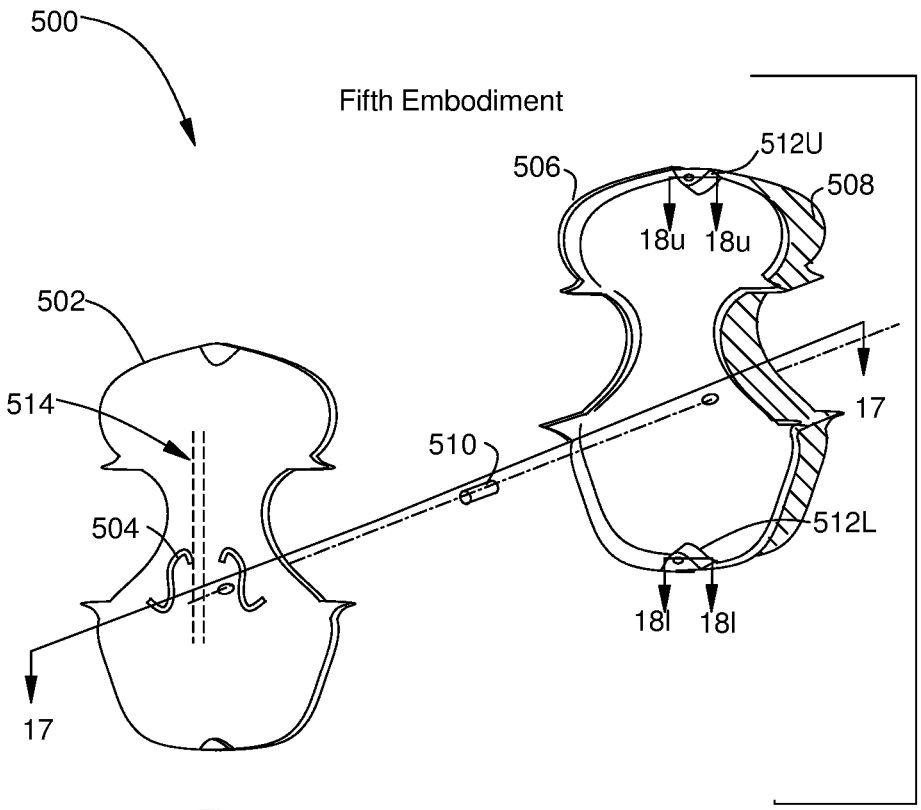
FIG. 16 illustrates an exploded view of a cello body of the fifth embodiment of the current invention.
Figure 17:
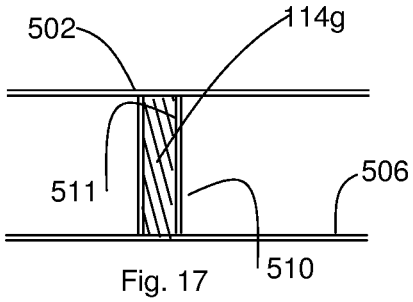
FIGS. 17, 18*u* and 18*l* are three sectional views of FIG. 16 illustrating the sound post, upper support block and lower support block of the fifth embodiment of the current invention.

FIG. 16 illustrates an exploded perspective view of a fifth embodiment 500 of the current invention. FIG. 17 is a sectional view of FIG. 16. Illustrated is the cello body top part 502 with two f slots 504 cello body back part 506 and cello body sides 508. Also shown is a sound post 510 which is a solid wood cylinder wood cylinder having a third shaft 511 that contains filler material 114*g* that transverses from the cello body top part 502 to the cello body back part 506, perpendicular to the planes of the cello body top part 502 and cello body back part 506. Also shown are an upper support block 512U and lower support block 512L containing filler material 114*h*. Also shown is the bass bar 514 having wood strip 516 containing filler material 114*i* as shown.

Figure 18U:
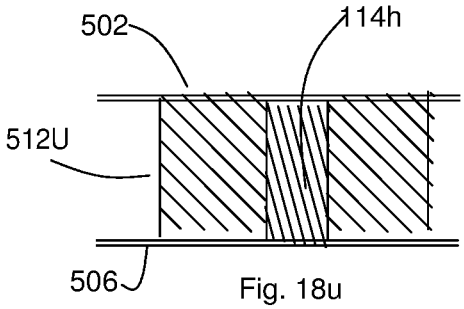
Figure 18L:
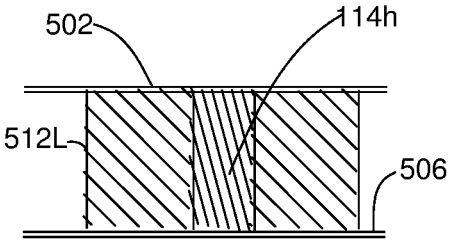

FIG. 17 illustrates a sectional view in an expanded scale of a portion of the cello with sound post 510 containing filler material 114*g*. FIGS. 18*u* and 181 illustrate sectional views of the upper and lower support blocks 512U and 512L containing filler material 114*h*. The filler material 114*g* and 114*h* in the fifth embodiment 500 are the same filler materials in the first embodiment.

Figure 19:
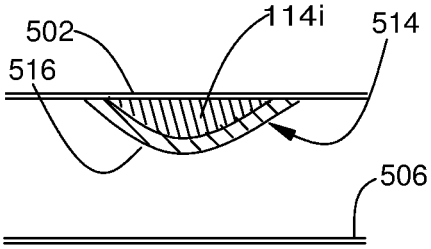
FIG. 19 illustrates a cross section of the bass bar of the fifth embodiment of the current invention.

FIG. 19 illustrates a sectional view of the bass bar 514 containing filler material 114*i*. Although not shown in the figures, the top and bottom ends of the bass bar 514 are sealed to prevent the filler material 114*i* from leaking.

Although the filler material described in the five embodiments and their alternate embodiments apply to string instruments and their accessories, the same concept applies to other devices that have acoustic outcomes such as the legs or support systems of any instrument that touches the floor boundary. These may include keyboard instruments percussion instruments.

Figure 20:
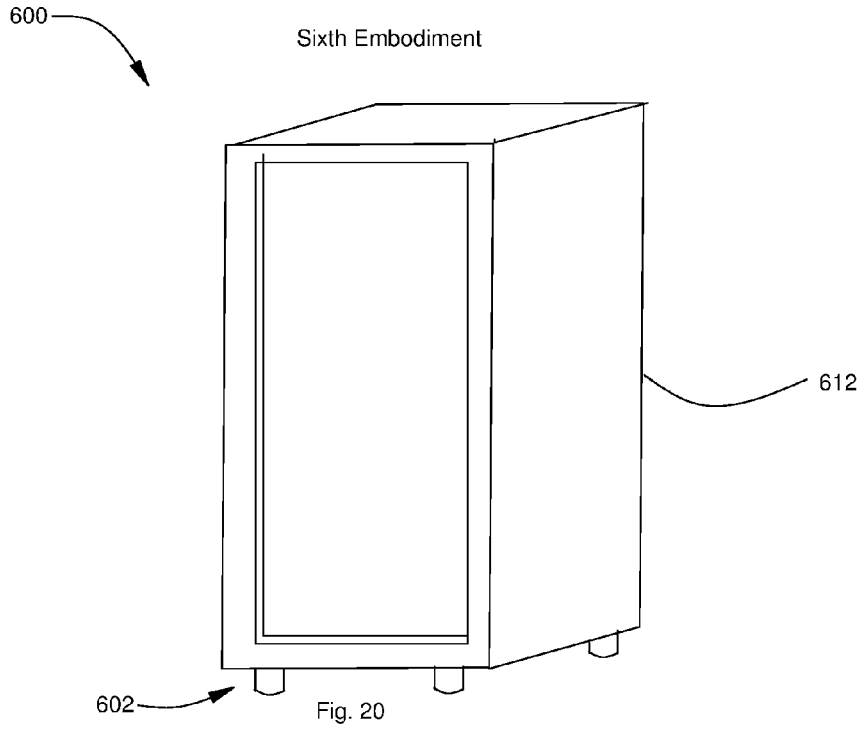
FIG. 20 illustrates four legs of the sixth embodiment used to support a speaker.
Figure 21:
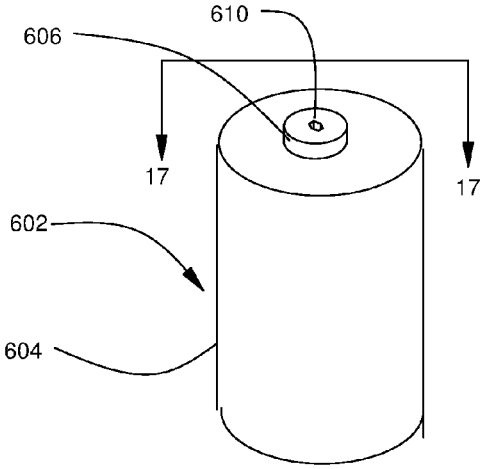
FIG. 21 illustrates one of the legs used to support a speaker of the sixth embodiment of the current invention.
Figure 22:
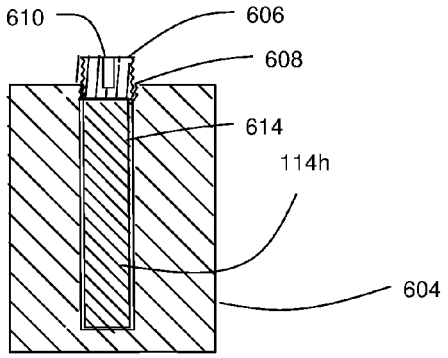
FIG. 22 is a sectional view of FIG. 21.

FIG. 20 illustrates a sixth embodiment 600 of the current invention, which consists of four feet 602, attached to a speaker 612. The speaker is not part of the embodiment. FIG. 21 is a perspective view of a foot 602. The four feet 602 are used to support the speaker 612. FIG. 22 is a sectional view of FIG. 21. Each foot 602 is constructed out of a solid cylinder 604 that has a cylindrical hole 614 located in the solid cylinder's interior along the vertical axis of solid cylinder 604. Cylindrical hole 614 is removably sealed with a cylindrical plug 606 that may be inserted in cylindrical hole 614 at the top using matching threads 608. Male component of threads 608 located on cylindrical plug 606 are used to be removably secured to female threads located in bottom of speaker 612 (female threads not shown). A hexagon shaped socket 610 is located on top center of cylindrical plug 606 is used to removably attach cylindrical plug 606 in cylindrical hole 614. The cylindrical hole 614 accommodates filler material 114*h*. Alternate embodiments of the sixth embodiments could have a different number of legs, and apply to the legs of other musical instruments such as, but not limited to, pianos and sound stages, electronic equipment, and microphone stands.

The disclosure presented herein gives six embodiments of the invention. These embodiments are to be considered as only illustrative of the invention and not a limitation of the scope of the invention. Various permutations, combinations, variations and extensions of these embodiments are considered to fall within the scope of this invention. Therefore, the scope of this invention should be determined with reference to the claims and not just by the embodiments presented herein.

What is claimed:

1. An acoustic device, said acoustic device configured to be used with a musical instrument, said acoustic device having at least one a shaft containing filler material;

said filler material is selected from the group consisting of shots, pellets, powders, magnetic material and a combination thereof;

said filler material being configured to customize acoustic outcome of said musical instrument when said musical instrument is used with said acoustic device;

and wherein said acoustic device having a mechanism for removably sealing said at least one shaft, said mechanism configured to replace said filler material installed in said at least one shaft with a different filler material;

wherein said musical instrument is a stringed musical instrument.

2. An acoustic device, said acoustic device configured to be used with a musical instrument, said acoustic device having at least one a shaft containing filler material;

said filler material is selected from the group consisting of shots, pellets, powders, magnetic material and a combination thereof;

said filler material being configured to customize acoustic outcome of said musical instrument when said musical instrument is used with said acoustic device;

and wherein said acoustic device having a mechanism for removably sealing said at least one shaft, said mechanism configured to replace said filler material installed in said at least one shaft with a different filler material;

said acoustic device being further comprised of a rod, said rod having a rod first end and a rod second end;

a first shaft positioned along longitudinal direction of said rod, said first shaft extending through interior of said rod, said first shaft being configured to be filled with said filler material;

said rod being configured to removably seal to said first shaft after said filler material is inserted into said first shaft;

a stopper; said stopper having a stopper first end and a stopper second end; said stopper being configured to attach to said rod at said rod second end, said rod being configured to attach to said musical instrument at said rod first end.

3. The acoustic device of claim 2 further comprising a pointed tip, said pointed tip attachable to said stopper at said stopper second end, said pointed tip comprised of a tip body and a tip point.

4. The acoustic device of claim 3 wherein said rod is made of brass having an outside diameter between 0.276 in, and 0.650 in, said rod having a length between 8 in and 24 in, and is sized to accommodate end user preferences, said first shaft has dimension between 0.157 in and 0.250 in.

5. The acoustic device of claim 3 wherein said tip body being comprised out of brass, and said pointed tip is made of tungsten and brazed to the tip body; said stopper has a height to 0.375 in with a 0.875 in diameter decreasing to diameter of 0.625 in diameter; said tip body being 1.5 in long.

6. An acoustic device, said acoustic device configured to be-used with a musical instrument, said acoustic device having at least one shaft containing filler material;

said filler material is selected from the group consisting of shots, pellets, powders, magnetic material and a combination thereof and wherein said acoustic device having a mechanism for removably sealing said at least one shaft configured to accommodate replacing said filler material installed in said at least one shaft with a different filler material;

said acoustic device being further comprised of a rod, said rod having a rod first end and a rod second end;

a first shaft positioned along longitudinal direction of said rod, said first shaft extending through interior of said rod, said first shaft configured to being filled with said filler material;

said rod being configured to removably seal to said first shaft after said filler material is inserted into said first shaft;

a stopper; said stopper having a stopper first end and a stopper second end; said stopper being configured to attach to said rod at said rod second end, said rod being configured to attach to said musical instrument at said rod first end, said acoustic device being further comprised of a pointed tip, said pointed tip attachable to said stopper at said stopper second end, said pointed tip comprised of a tip body and a tip point;

said acoustic device additionally has a stem, said stem having a stem first end and a stem second end, said stem attachable to said rod first end, said stem has a second shaft starting at said stem first end and terminating prior to said stem second end; said second shaft configured to contain said filler material; said stem second end being matched to a cavity located on said rod first end; said stem second end being removably attachable to said cavity.

7. The acoustic device of claim 6 further comprising a locking collet nut that attaches and secures a tapered collet body with a castle to said rod at said rod first end, said tapered collet body being removably attachable to said musical instrument wherein taper of said tapered collet body reduces standing wave resonance by the tapered collet body and additionally by irregular facets of the castle, and said tapered collet body generates more and varied acoustic pressure within the musical instrument, and said castle with its varied facets of shapes and sizes of the tapered collet body additionally allows for collection and generation of more varied acoustic resonance within said musical instrument.

8. The acoustic device of claim 7 wherein said locking collet nut has a plurality of bores positioned on said locking collet nut.

9. The acoustic device of claim 8 wherein said plurality of bores of said locking collet nut has said filler material added to at least one of said plurality of bores, said least one of said plurality of bores being removably sealable to retain said filler material wherein said plurality of bores and said filler material being selected so that said plurality of bores and said filler material provide a variety of resonance characteristic.

10. An acoustic device, said acoustic device being used with a musical instrument, said acoustic device comprised of a pedestal having a depression, said pedestal additionally having a plurality of legs emanating from bottom of said pedestal, each of said plurality of legs being removably attachable to said pedestal, each of said plurality of legs having a shaft that accommodates filler material;

said filler material is selected from the group consisting of shots, pellets, powders, magnetic material and a combination thereof;

said filler material is configured to customize acoustic outcome of said musical instrument when said acoustic device is used with said musical instrument.

11. The acoustic device of claim 10, additionally comprised of a ball tip, said ball tip having a sphere attached to its lower end, said depression being able to accommodate said sphere that allows said ball tip to rotate freely within it, said ball tip being removably attachable to bottom of said musical instrument.

12. An acoustic device, said acoustic device configured to be used with a musical instrument, said acoustic device having at a shaft containing filler material;

said filler material is selected from the group consisting of shots, pellets, powders, magnetic material and a combination thereof;

said filler material being configured to customize acoustic outcome of said musical instrument when said musical instrument is used with said acoustic device;

said acoustic device being used with a stringed musical instrument having a body top part, a body bottom part, an inside top part and an inside bottom part, said acoustic device comprised of a sound post, said sound post being comprised of a solid material that contain said shaft, said shaft transverses from said body top part to said body bottom part, said shaft being orthogonal to planes of the body top part and body back part.

13. The acoustic device of claim 12 additionally comprised of at least one of an upper support bloc containing said filler material, a lower support block containing said filler material, and a bass bar containing said filler material.

* * * * *